US006082445A

United States Patent [19]

Dugan

[11] Patent Number: 6,082,445

[45] Date of Patent: Jul. 4, 2000

[54] PLATE-TYPE HEAT EXCHANGERS

[75] Inventor: Jeffrey S. Dugan, Asheville, N.C.

[73] Assignee: BASF Corporation, Mt. Oliver, N.J.

[21] Appl. No.: 08/392,493

[22] Filed: Feb. 22, 1995

[51] Int. Cl.[7] ..... F28F 3/08

[52] U.S. Cl. ..... 165/167; 165/DIG. 364

[58] Field of Search ..... 165/166, 167, 165/165

[56] References Cited

U.S. PATENT DOCUMENTS

| | | | |
|---|---|---|---|
| 2,217,316 | 10/1940 | Kallstenius | 165/167 |
| 2,690,328 | 9/1954 | Keesling | 165/166 |
| 2,960,160 | 11/1960 | Goodman | 165/167 X |
| 3,255,817 | 6/1966 | Davids et al. . | |
| 4,073,340 | 2/1978 | Parker . | |
| 4,308,915 | 1/1982 | Sanders et al. . | |
| 4,310,960 | 1/1982 | Parker . | |
| 4,335,782 | 6/1982 | Parker . | |
| 4,407,357 | 10/1983 | Hultgren . | |
| 4,569,391 | 2/1986 | Hulswitt et al. . | |
| 4,572,766 | 2/1986 | Dimitriou . | |
| 4,665,975 | 5/1987 | Johnston | 165/167 |
| 4,674,568 | 6/1987 | Landry et al. | 165/166 |
| 4,823,867 | 4/1989 | Pollard et al. . | |
| 5,271,459 | 12/1993 | Daschmann . | |

FOREIGN PATENT DOCUMENTS

| | | | |
|---|---|---|---|
| 80083 | 5/1985 | Japan | 165/167 |
| 93291 | 5/1985 | Japan | 165/167 |
| 1078230 | 3/1984 | U.S.S.R. | 165/167 |
| 1086338 | 4/1984 | U.S.S.R. | 165/166 |
| 2019550 | 10/1979 | United Kingdom | 165/167 |

*Primary Examiner*—Leonard Leo

[57] ABSTRACT

A heat exchanger contains one or more heat exchange plates having on a common facial surface thereof a first heating fluid facial subchannel set containing at least one heating fluid facial subchannel and a first cooling fluid facial subchannel set containing at least one cooling fluid facial subchannel; wherein the heating fluid facial subchannel set and the cooling fluid facial subchannel set are mutually aligned in a heat exchange relationship on the common facial surface of the heat exchange plate(s). In one embodiment, the heat exchanger contains at least one pair of heat exchange plates, wherein a first plate in the pair has on a front facial surface thereof a first-plate heating fluid facial subchannel set and a first-plate cooling fluid facial subchannel set, and a second plate in the pair has on a front facial surface thereof a second-plate heating fluid facial subchannel set and a second-plate cooling fluid facial subchannel set, wherein the first-plate heating fluid facial subchannel set is aligned in heat exchange relationships with the first-plate cooling fluid facial subchannel set and the second-plate cooling fluid facial subchannel set, and the second-plate heating fluid facial subchannel set is aligned in heat exchange relationships with the second-plate cooling fluid facial subchannel set and the first-plate cooling fluid facial subchannel set.

27 Claims, 3 Drawing Sheets

PLATE-TYPE HEAT EXCHANGERS

BACKGROUND OF THE INVENTION

This invention relates to plate-type heat exchangers. More particularly, this invention relates to plate-type heat exchangers useful for exchanging heat between two or more fluids of differing heat content.

Heat exchangers provide a means for transferring thermal energy from one fluid stream to another while permitting no mixing of the streams to occur. It is known that heat exchange between a cold stream entering a process and a hot stream produced in or leaving the process reduces the total energy requirement of that process by recycling the heat energy provided by the hot stream. As a result, heat exchangers are commonly used in thermoelectric devices such as furnaces, incinerators and the like to increase the energy efficiency of such devices through the use of recycled heat energy.

Various types of heat exchangers exist, such as, for example, plate-type heat exchangers, fin and tube-type heat exchangers, and shell and tube-type heat exchangers. Plate-type heat exchangers are generally less expensive and easier to make than the other types of heat exchangers. As a result, plate-type heat exchangers tend to be more widely used in industrial applications requiring high performance and efficiency with relatively low cost, small volume, and light weight. Such applications include, for example, vehicle gas turbines.

Although plate-type heat exchangers are generally less complicated and more easily made than the fin- and tube-types of heat exchangers, many plate-type heat exchangers are still undesirably bulky and expensive to make. For example, the plates in many conventional plate-type heat exchangers are made of thick metal. Such thick metal plates make these plate-type heat exchangers bulky and, therefore, more expensive to make, inspect, clean, re-use or replace. In addition, plate-type heat exchangers generally contain at least two heat exchange plates and frequently more.

It would be desirable, therefore, to provide plate-type heat exchangers which are less bulky. Less bulky plate-type heat exchangers can be produced more economically and more efficiently on demand with a variety of different interchangeable structures to satisfy a wide variety of needs.

Plate-type heat exchangers are disclosed, for example, in U.S. Pat. Nos. 4,308,915; 5,025,856; 5,271,459; 4,572,766; 4,310,960; 3,255,817; 4,407,357; 4,335,782; and 4,073,340.

U.S. Pat. No. 4,308,915 to Sanders et al. discloses a thin sheet heat exchanger for transferring heat between two gases, wherein the sheets may have formed therein a crossflow pattern, a combination of a crossflow and a counterflow pattern or any other combination of channel patterns.

U.S. Pat. No. 5,025,856 to VanDyke et al. teaches a crossflow, plate-type heat exchanger for transferring heat between first and second fluids, wherein the heat exchanger is composed of a plurality of heat conductive plates having channels formed therein by micromachining methods such as etching.

U.S. Pat. No. 5,271,459 to Daschmann discloses a plate-type heat exchanger for exchanging heat between two fluids, wherein the heat exchanger is composed of a plurality of stacks of form-stamped plates combined to form pairs and the pairs assembled atop one another to form one stack. First flow channels for a first fluid are formed between the plates of one pair and second flow channels for a second fluid are formed between adjacent ones of the pairs, the stacks being arranged directly adjacent to one another to form a stack assembly.

U.S. Pat. No. 4,407,357 to Hultgren discloses a thin, metal heat exchanger having countercurrent flow of media on opposite sides of spaced walls.

U.S. Pat. No. 4,572,766 to Dimitriou discloses a plate evaporator or condenser having a plurality of plates forming a plate stack and defining alternating chambers in separate plates for a first fluid to be evaporated and a second fluid to be condensed.

U.S. Pat. Nos. 4,310,960; 4,073,340; and 4,335,782, all to Parker, disclose plate-type heat exchangers composed of a stack of relatively thin material, spaced heat transfer plates. The plates define sets of multiple counterflow fluid passages for two separate fluid media alternating with each other. Each plate contains a flow path for one of the two fluid media. The plates are arranged so that one fluid stream flows in one direction between adjacent streams of the other fluid which flows in an opposite direction.

U.S. Pat. No. 4,823,867 to Pollard et al. discloses a heat exchanger composed of a core element, wherein the core element contains a plurality of substantially parallel plates in stacked relationship to define a multiplicity of flow passages for a working fluid alternating with a plurality of flow passages for a process fluid, the working fluid flow passages being substantially parallel to the process fluid flow passages.

U.S. Pat. No. 3,255,817 to Davids et al. teaches a plate-type heat exchanger composed of horizontally stacked or nested heat exchange plates providing three fluid flow heat exchange paths in the heat exchanger.

Energy efficient heat pumps composed of a condenser, an evaporator, and a compressor made by photoetching tiny grooves and channels which are "about two human hairs deep" into a "piece of metal about the size of a dime" are described in *Business Week*, p. 129, May 30, 1994.

The heat exchangers disclosed in the references cited above require at least two heat exchange plates. None contain only one heat exchange plate. It would be desirable to provide a heat exchanger which can provide heat exchange using only one heat exchange plate. It would be further desirable to provide a heat exchanger which can provide heat exchange on a single surface of a single heat exchange plate.

Furthermore, while some of the heat exchangers disclosed in the references cited hereinabove provide high surface-to-volume ratios and some of the heat exchangers provide countercurrent heat exchange between two heat exchange fluids, none appear to provide both high surface-to-volume ratios and countercurrent heat exchange. It would be desirable to provide a heat exchanger which can provide both a high surface-to-volume ratio and countercurrent heat exchange.

A further drawback of conventional heat exchangers is their failure to provide three-dimensional heat exchange. It would be desirable to provide a heat exchanger which can provide three-dimensional heat exchange.

Accordingly, a primary object of this invention is to provide a heat exchanger capable of providing heat exchange using a single heat exchange plate.

A further object of this invention is to provide a heat exchanger capable of providing heat exchange using only a single surface of a single heat exchange plate.

A further object of this invention is to provide a heat exchanger which is less bulky and less expensive to make, inspect, clean, re-use or replace.

Another object of this invention is to provide a heat exchanger capable of providing both a high surface-to-volume ratio and countercurrent heat exchange.

A further object of this invention is to provide a heat exchanger capable of providing three-dimensional heat exchange.

An additional object of this invention is to provide a method of exchanging heat between two or more fluids of differing heat content, using a heat exchanger having the properties described in the foregoing objects.

These and other objects which are achieved according to the present invention can be discerned from the following description.

SUMMARY OF THE INVENTION

The present invention provides a heat exchanger, containing one or more heat exchange plates having on a common facial surface thereof:

(A) a first heating fluid facial subchannel set containing at least one heating fluid facial subchannel; and (B) a first cooling fluid facial subchannel set containing at least one cooling fluid facial subchannel;

wherein the first heating fluid facial subchannel set and the first cooling fluid facial subchannel set are mutually aligned in a first heat exchange relationship on the common facial surface.

In one embodiment, the heat exchanger of this invention contains at least one pair of heat exchange plates, wherein a first plate in the pair has on a front facial surface thereof a first first-plate heating fluid facial subchannel set containing one or more first first-plate heating fluid facial subchannels and a first first-plate cooling fluid facial subchannel set containing one or more first first-plate cooling fluid facial subchannels, and a second plate in the pair has on a front facial surface thereof a first second-plate heating fluid facial subchannel set containing one or more first second-plate heating fluid facial subchannels and a first second-plate cooling fluid facial subchannel set containing one or more first second-plate cooling fluid facial subchannels, wherein the first first-plate heating fluid flow facial subchannel set is aligned in heat exchange relationships with the first first-plate cooling fluid facial subchannel set and the first second-plate cooling fluid facial subchannel set, and the first second-plate heating fluid facial subchannel set is aligned in heat exchange relationships with the first second-plate cooling fluid facial subchannel set and the first first-plate cooling fluid facial subchannel set.

The present invention is further directed to a method of exchanging heat between one or more heating fluids and one or more cooling fluids, wherein the heating fluid(s) and cooling fluid(s) are passed through the heating fluid facial subchannel set(s) and the cooling fluid facial subchannel set(s), respectively, of the heat exchanger of this invention.

The heat exchanger of this invention is compact and relatively easy and inexpensive to make, inspect, clean, re-use and replace. Furthermore, the heat exchanger of this invention can provide heat exchange between heating and cooling fluids on a common surface of a single heat exchange plate. The heat exchanger of this invention may also provide three-dimensional heat exchange. Furthermore, the heat exchanger of this invention can provide a high surface-to-volume ratio.

DETAILED DESCRIPTION OF THE INVENTION

Figure 1:
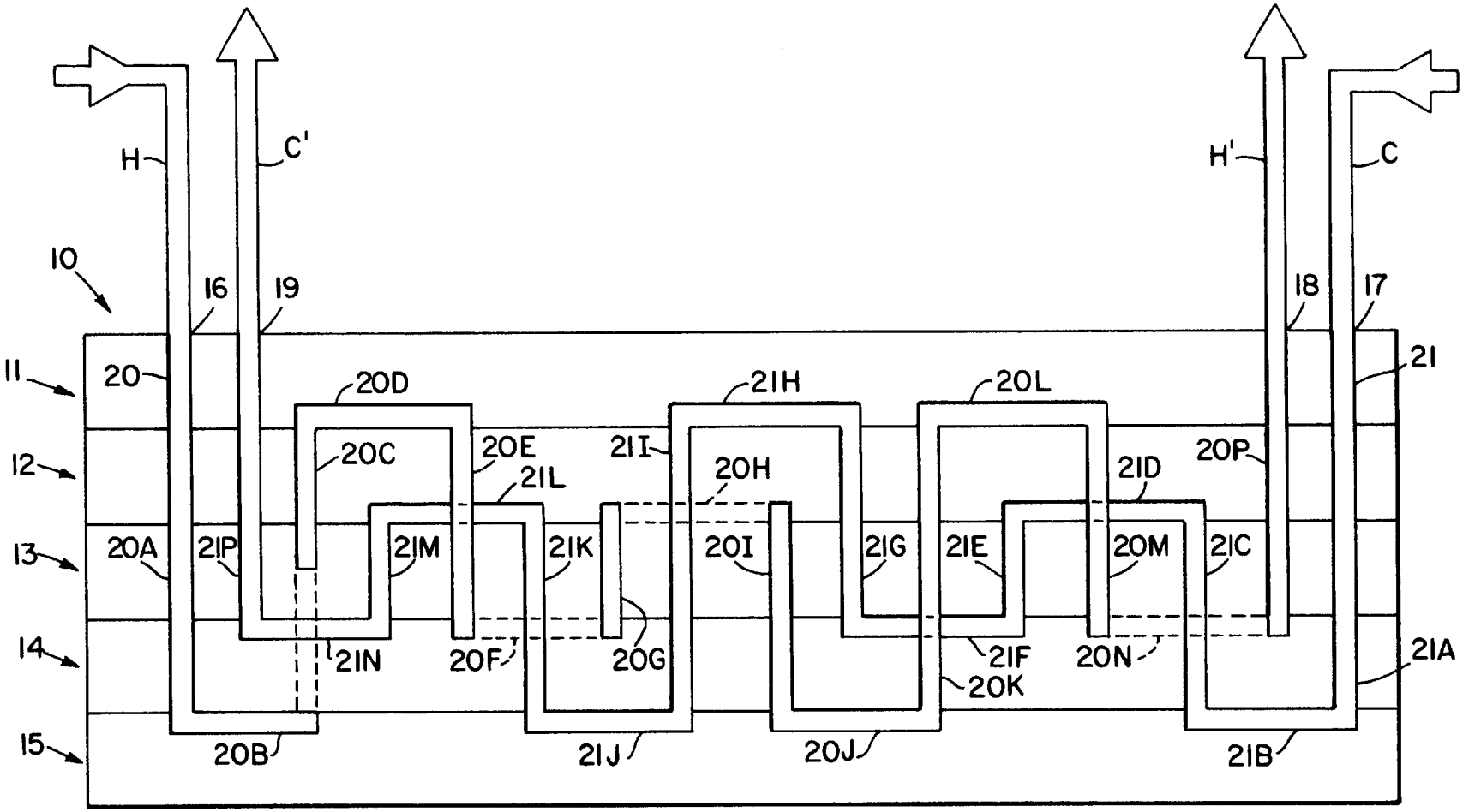
FIG. 1 is a schematic illustration of a side view of a first embodiment of a heat exchanger within the scope of this invention.

The heat exchanger of this invention is useful for exchanging heat between one or more heating fluids and one or more cooling fluids. The heat exchanger contains one heat exchange plate or a plurality of substantially parallel heat exchange plates stacked in a front-to-back configuration. One or more primary heating fluid channels and one or more primary cooling fluid channels continuously pass through the plate or plates of the heat exchanger. The primary heating and cooling fluid channels separately pass through the heat exchanger and never come into physical contact with one another therein. Each of the primary heating and cooling fluid channels extends separately from inlets to outlets in the heat exchanger.

The primary heating and cooling fluid channels are divided into a plurality of subchannels. One or more of the subchannels extends from one point on a facial surface of a plate to a second point on the same facial surface of the plate. These subchannels will be referred to herein as "facial subchannels". One or more of the subchannels extend from a point on one facial surface of a plate to a point on the other facial surface of the plate by passing through the plate. These subchannels will be referred to herein as "transversing subchannels".

In one or more of the heat exchange plates in the heat exchanger of this invention, at least one facial surface of the plate contains thereon (A) a first heating fluid facial subchannel set and (B) a first cooling fluid facial subchannel set. The first heating fluid facial subchannel set contains one or more facial subchannels, and the first cooling fluid facial subchannel set contains one or more facial subchannels. Thus, in one embodiment of the heat exchanger of this invention, one heating fluid facial subchannel and one cooling fluid facial subchannel on a common facial surface of a plate can be mutually aligned in a first heat exchange relationship. Alternatively, a plurality of heating fluid facial subchannels and a plurality of cooling fluid facial subchannels can be mutually aligned in the first heat exchange relationship. The first heat exchange relationship is preferably composed of a countercurrent or concurrent heat exchange relationship; more preferably, a countercurrent heat exchange relationship. The heating and cooling fluid facial subchannels on the common facial surface of the plate are also mutually aligned in an alternating, parallel fashion on the common facial surface.

The heating and cooling fluid subchannels on a common facial surface of a plate can each have a linear or non-linear flow path. Alternatively, the heating fluid facial subchannel (s) may have a non-linear flow path while the cooling fluid facial subchannel(s) has a linear flow path or the cooling fluid facial subchannel(s) may have a non-linear flow path while the heating fluid facial subchannel(s) has a linear flow path.

In one embodiment of the heat exchanger of this invention, the non-linear flow path contains a first longitudinal portion, a second longitudinal portion and a third non-linear end portion contiguous with the first longitudinal portion and the second longitudinal portion, wherein the linear flow path and the first longitudinal portion are mutually aligned in a heat exchange relationship, preferably a concurrent or countercurrent heat exchange relationship; the linear flow path and the second longitudinal portion are mutually aligned in a heat exchange relationship, preferably a concurrent or countercurrent heat exchange relationship; and the linear flow path and the third non-linear end portion are mutually aligned in a heat exchange relationship, preferably a crosscurrent heat exchange relationship.

In another embodiment of the heat exchanger of this invention, a common facial surface of a plate contains the first heating and cooling fluid facial subchannel sets described hereinabove and further contains thereon a second heating fluid facial subchannel set and a second cooling fluid facial subchannel set. The second heating fluid facial subchannel set may contain one second heating fluid facial subchannel or a plurality of second heating fluid facial subchannels. Likewise, the second cooling fluid subchannel set may contain one cooling fluid facial subchannel or a plurality of cooling fluid facial subchannels.

The second heating fluid facial subchannel set and the first cooling fluid facial subchannel set are mutually aligned in a second heat exchange relationship, while the second cooling fluid facial subchannel set and the first heating fluid facial subchannel set are mutually aligned in a third heat exchange relationship. The second heat exchange relationship is preferably composed of a countercurrent or concurrent heat exchange relationship; more preferably, a countercurrent heat exchange relationship. The third heat exchange relationship is preferably made up of a countercurrent or concurrent heat exchange relationship; more preferably, a countercurrent heat exchange relationship.

In addition, the second heating fluid facial subchannel set and the second cooling fluid facial subchannel set can be mutually aligned in a fourth heat exchange relationship, preferably in a countercurrent or concurrent heat exchange relationship and, more preferably, a countercurrent heat exchange relationship.

The second heating fluid facial subchannel set is spaced apart from the first heating fluid facial subchannel set, while the second cooling fluid subchannel set is spaced apart from the first cooling fluid subchannel facial set. Preferably, the second heating fluid facial subchannel set is longitudinally spaced in end-to-end fashion from the first heating fluid facial subchannel set, and the second cooling fluid facial subchannel set is longitudinally spaced in end-to-end fashion from the first cooling fluid facial subchannel set.

In yet another embodiment of the heat exchanger of this invention, the heat exchanger is made up of a plurality of heat exchange plates stacked in a parallel, face-to-face configuration, wherein the plurality of heat exchange plates is composed of at least one pair of heat exchange plates designated herein as a first heat exchange plate and a second heat exchange plate.

The first heat exchange plate has on a facial surface thereof a first first-plate heating fluid facial subchannel set and a first first-plate cooling fluid facial subchannel set. The first first-plate heating fluid facial subchannel set is composed of one or more first-plate heating fluid facial subchannels. The first first-plate cooling fluid facial subchannel set is composed of one or more first-plate cooling fluid facial subchannels.

The second heat exchange plate has on a facial surface thereof a first second-plate heating fluid facial subchannel set and a first second-plate cooling fluid facial subchannel set. The first second-plate heating fluid facial subchannel set is composed of one or more second-plate heating fluid facial subchannels. The first second-plate cooling fluid facial subchannel set is composed of one or more second-plate cooling fluid facial subchannels.

The first and second heat exchange plates are stacked in a face-to-face, substantially parallel configuration. Preferably, the first and second heat exchange plates are stacked in a front-to-back configuration. The term "front" in the term "front-to-back" is used herein to refer to a plate's facial surface which contains thereon one or more heating fluid facial subchannels and one or more cooling fluid facial subchannels. The term "back" in the term "front-to-back" is used herein to refer to a plate's facial surface which does not contain heating fluid or cooling fluid facial subchannels thereon. Thus, the term "front-to-back" as used herein means that the front facial surface of a plate is in directed face-to-face contact with the back facial surface of the other plate. Although the plates may be arranged in a "front-to-front" configuration, it is preferred that the plates are arranged in a "front-to-back arrangement.

In the embodiment of the heat exchanger of this invention wherein the heat exchanger contains the first and second heat exchange plates described hereinabove:

(a) the first first-plate heating fluid facial subchannel set and the first first-plate cooling fluid facial subchannel set are mutually aligned in a fifth heat exchange relationship;

(b) the first second-plate heating fluid facial subchannel set and the first second-plate cooling fluid facial subchannel set are mutually aligned in a sixth heat exchange relationship;

(c) the first first-plate heating fluid facial subchannel set and the first second-plate cooling fluid facial subchannel set are mutually aligned in a seventh heat exchange relationship; and (d) the first first-plate cooling fluid facial subchannel set and the first second-plate heating fluid facial subchannel set are mutually aligned in an eighth heat exchange relationship.

Preferably, the fifth heat exchange relationship is made up of a concurrent or countercurrent heat exchange relationship; the sixth heat exchange relationship is composed of a concurrent or countercurrent heat exchange relationship; the seventh heat exchange relationship is made up of a concurrent, countercurrent or crosscurrent heat exchange relationship; and the eighth heat exchange relationship is composed of a concurrent, countercurrent or crosscurrent heat exchange relationship.

In another embodiment of the heat exchanger of this invention, the first plate further has on the front facial surface thereof a second first-plate heating fluid facial subchannel set and a second first-plate cooling fluid facial subchannel set. The second first-plate heating fluid facial subchannel set contains at least one second first-plate heating fluid facial subchannel, while the second first-plate cooling fluid facial subchannel set contains at least one second first-plate cooling fluid facial subchannel. The second first-plate heating fluid facial subchannel set is spaced apart from the first first-plate heating fluid facial subchannel set, and the second first-plate cooling fluid facial subchannel set is spaced apart from the first first-plate cooling fluid facial subchannel set. The second first-plate heating fluid facial subchannel set and the first first-plate cooling fluid facial subchannel set are mutually aligned in an eighth heat exchange relationship and the second first-plate cooling fluid facial subchannel set and the first first-plate heating fluid facial subchannel set are mutually aligned in a ninth heat exchange relationship. Preferably, the eighth heat exchange relationship comprises a countercurrent or concurrent heat exchange relationship and the ninth heat exchange relationship comprises a countercurrent or concurrent heat exchange relationship.

In another embodiment of the heat exchanger of this invention, the second plate further has on the front facial surface thereof a second second-plate heating fluid facial subchannel set comprising at least one second second-plate heating fluid facial subchannel, and a second second-plate cooling fluid facial subchannel set comprising at least one second second-plate cooling fluid facial subchannel. The second second-plate heating fluid facial subchannel set is spaced apart from the first second-plate heating fluid facial subchannel set and the second second-plate cooling fluid facial subchannel set is spaced apart from the first second-plate cooling fluid facial subchannel set.

The second second-plate heating fluid facial subchannel set and the first second-plate cooling fluid facial subchannel set are mutually aligned in a tenth heat exchange relationship, and the second second-plate cooling fluid facial subchannel set and the first second-plate heating fluid facial subchannel set are mutually aligned in an eleventh heat exchange relationship. Preferably, the tenth heat exchange relationship comprises a countercurrent or concurrent heat exchange relationship and the eleventh heat exchange relationship comprises a countercurrent or concurrent heat exchange relationship.

The second second-plate heating fluid subchannel set and the second first-plate cooling fluid subchannel set are mutually aligned in a twelfth heat exchange relationship; and the second second-plate cooling fluid subchannel set and the second first-plate heating fluid subchannel set are mutually aligned in a thirteenth heat exchange relationship. Preferably, the twelfth heat exchange relationship comprises a countercurrent or concurrent heat exchange relationship and the thirteenth heat exchange relationship comprises a countercurrent or concurrent heat exchange relationship.

When the heat exchanger of this invention is composed of a plurality of heat exchange plates, the plates are preferably joined to one another to form a rigid structure. The plates may be removably held together and made leakproof by means of pressure, bolts, rivets, clamps and the like; or the plates may be laminated, bonded, glued, soldered, or brazed together to form a composite. Preferably, the individual plates are removably attached to one another to facilitate cleaning, inspection and re-use of the plates.

The shape, dimensions and composition of the plates used in the heat exchanger of this invention may be the same as those found in heat exchange plates used in conventional plate-type heat exchangers.

The heat exchange plates used in the present invention are preferably thin. The heat exchange plates preferably have a thickness of from about 0.001 to about 1.0 inch, more preferably from about 0.001 to about 0.25 inch, and most preferably from about 0.01 to about 0.10 inch.

The plates can be made of any thermally conductive material. Preferably, the plates are made of metal such as, for example, stainless steel, aluminum, aluminum-based alloys, nickel, iron, copper, copper-based alloys, mild steel, brass, titanium and other thermally conductive metals. Because it is relatively inexpensive, stainless steel is typically used in the heat exchange plates.

The fluid channels, subchannels, inlets and outlets (collectively referred to herein as "fluid channels") on the surface(s) of the heat exchange plate(s) used in the present invention can be formed by any machining process (e.g., drilling, reaming and the like) conventionally used to form fluid channels. Preferably, the flow channels are formed in the heat exchange plates by a micromachining process, such as, for example, etching, stamping, punching, pressing, cutting, molding, milling, lithographing, particle blasting, or combinations thereof. Most preferably, the fluid channels are etched into the heat exchange plates. Etching, e.g., photochemical etching, provides precisely formed flow patterns while being less expensive than many other conventional machining processes. Furthermore, etched perforations generally do not have the sharp corners, burrs, and sheet distortions associated with mechanical perforations. Etching processes are well known in the art. Typically, etching is carried out by contacting a surface with a conventional etchant.

Etching permits the heat exchange channels, subchannels and apertures to be precisely defined with very small length (L) to diameter (D) ratios. For example, the apertures have L/D ratios of preferably about 1.5 or less, more preferably about 0.7 or less. The depth of the channels, subchannels and apertures is preferably at least about 70% of the thickness of the plate on which the channels, subchannels and apertures are situated. While the length of the apertures will depend on the thickness of the particular plate and the particular diameter of the channels, subchannels and apertures, the length of the channels and subchannels is not dependent on these factors. The channels, subchannels and apertures are micromachined to a depth of preferably less than or equal to about 0.25 inch and more preferably of less than or equal to about 0.10 inch. It is to be understood, however, that the particular diameter, length and depth of the channels, subchannels and apertures will depend on the particular application.

As mentioned previously herein, the heat exchanger of this invention preferably has a high surface-to-volume ratio. This can be achieved by placing the channels and/or subchannels as close together as possible; increasing the volume of fluid in the channels and/or subchannels; and/or maximizing the area of contact between the surface(s) of the heat exchange plate(s) and the fluid(s) passing through the heat exchanger. In the heat exchanger of this invention, the distance between a heating fluid facial subchannels and a cooling fluid facial subchannel adjacent thereto on a common facial surface of a heat exchange plate is that distance sufficient to provide a heat exchange relationship between the heating and cooling fluid facial subchannels. Preferably, a heating fluid facial subchannel and an adjacent cooling fluid facial subchannel on a common facial surface of a heat exchange plate in the heat exchanger of this invention are separated from one another by a distance of not greater than about 0.25 inch.

The heat exchange plates used in the present invention may have any shape, e.g., square, rectangular, circular, and the like. Typically, the plates are rectangular-shaped or square-shaped.

In the method of this invention, heat exchange between one or more heating fluids and one or more cooling fluids is carried out by passing the one or more heating fluids and the one or more cooling fluids through the heat exchanger of this invention described hereinabove.

Generally, the method of this invention comprises the steps of:

(1) providing a heat exchanger within the scope of the present invention, and (2) passing the heating fluid(s) through the first heating fluid facial subchannel set while passing the cooling fluid(s) through the first cooling fluid facial subchannel set.

In a further embodiment of the method of this invention, the heating fluid(s) is passed through the first heating fluid facial subchannel set and the second heating fluid facial subchannel set while the cooling fluid(s) is passed through the first cooling fluid facial subchannel set and the second cooling fluid facial subchannel set.

In another embodiment of the method of this invention, the heating fluid(s) is passed through the first first-plate heating fluid facial subchannel set and the first second-plate heating fluid facial subchannel set, while the cooling fluid(s) is passed through the first first-plate cooling fluid facial subchannel set and the first second-plate cooling fluid facial subchannel set.

In yet another embodiment of the method of this invention, the heating fluid(s) is passed through the first first-plate heating fluid facial subchannel set, the second first-plate heating fluid facial subchannel set and the first and/or the second second-plate heating fluid facial subchannel set, while the cooling fluid(s) is passed through the first first-plate cooling fluid facial subchannel set, the second first-plate cooling fluid facial subchannel set, and the first and/or the second second-plate cooling fluid facial subchannel set.

The term "fluid" as used herein includes liquids, gases, and liquid/gas combinations. For example, the heating fluid can be air or steam while the cooling fluid is water.

This invention will be explained in greater detail with respect to FIGS. 1–4 herein.

FIG. 1 is a side view of one embodiment of a heat exchanger within the scope of this invention. In FIG. 1, heat exchanger 10 contains five heat exchange plates, 11–15, situated in a parallel, front-to-back stacked configuration. A heating fluid H and a cooling fluid C enter heat exchanger 10 via inlets 16 and 17, respectively, and exit heat exchanger 10 via outlets 18 and 19, respectively, wherein heating fluid H exits as cooled fluid H' and cooling fluid C exits as heated fluid C'. Heating fluid H flows through a continuous heating fluid channel 20 which extends from inlet 16 to outlet 18. Channel 20 is subdivided into multiple subchannels, 20A–20P. Meanwhile, cooling fluid C flows through a continuous cooling fluid channel 21 which extends from inlet 17 to outlet 19. Channel 21 is subdivided into multiple subchannels, 21A–21P.

In heat exchanger 10, heating fluid subchannels and cooling fluid subchannels which are mutually aligned in a heat exchange relationship include at least the following:

(1) subchannels 20A and 21P in a countercurrent heat exchange relationship;

(2) subchannels 20B and 21N in a countercurrent heat exchange relationship;

(3) subchannels 20B and 21J in a countercurrent heat exchange relationship;

(4) subchannels 20C and 21P in a concurrent heat exchange relationship;

(5) subchannels 20C and 21M in a countercurrent heat exchange relationship;

(6) subchannels 20C and 21N in a crosscurrent heat exchange relationship;

(7) subchannels 20D and 21H in a countercurrent heat exchange relationship;

(8) subchannels 20D and 21L in a countercurrent heat exchange relationship;

(9) subchannels 20E and 21M in a concurrent heat exchange relationship;

(10) subchannels 20E and 21K in a countercurrent heat exchange relationship;

(11) subchannels 20E and 21L in a crosscurrent heat exchange relationship;

(12) subchannels 20F and 21J in a countercurrent heat exchange relationship;

(13) subchannels 20F and 21N in a countercurrent heat exchange relationship;

(14) subchannels 20F and 21K in a crosscurrent heat exchange relationship;

(15) subchannels 20G and 21K in a concurrent heat exchange relationship;

(16) subchannels 20G and 21I in a countercurrent heat exchange relationship;

(17) subchannels 20G and 21J in a crosscurrent heat exchange relationship;

(18) subchannels 20H and 21H in a countercurrent heat exchange relationship;

(19) subchannels 20H and 21L in a countercurrent heat exchange relationship;

(20) subchannels 20H and 21I in a crosscurrent heat exchange relationship;

(21) subchannels 20H and 21D in a countercurrent heat exchange relationship;

(22) subchannels 20I and 211 in a concurrent heat exchange relationship;

(23) subchannels 20I and 21G in a countercurrent heat exchange relationship;

(24) subchannels 20I and 21H in a crosscurrent heat exchange relationship;

(25) subchannels 20J and 21J in a countercurrent heat exchange relationship;

(26) subchannels 20J and 21B in a countercurrent heat exchange relationship;

(27) subchannels 20J and 21F in a countercurrent heat exchange relationship;

(28) subchannels 20J and 21G in a crosscurrent heat exchange relationship;

(29) subchannels 20K and 21G in a concurrent heat exchange relationship;

(30) subchannels 20K and 21B in a countercurrent heat exchange relationship;

(31) subchannels 20K and 21F in a crosscurrent heat exchange relationship;

(32) subchannels 20L and 21H in a countercurrent heat exchange relationship;

(33) subchannels 20L and 21D in a countercurrent heat exchange relationship;

(34) subchannels 20L and 21B in a crosscurrent heat exchange relationship;

(35) subchannels 20M and 21E in a concurrent heat exchange relationship;

(36) subchannels 20M and 21C in a countercurrent heat exchange relationship;

(37) subchannels 20M and 21D in a crosscurrent heat exchange relationship;

(38) subchannels 20N and 21F in a countercurrent heat exchange relationship;

(39) subchannels 20N and 21B in a countercurrent heat exchange relationship;

(40) subchannels 20N and 21C in a crosscurrent heat exchange relationship;

(41) subchannels 20P and 21C in a concurrent heat exchange relationship;

(42) subchannels 20P and 21A in a countercurrent heat exchange relationship; and

(43) subchannels 20P and 21B in a crosscurrent heat exchange relationship.

Figure 2:
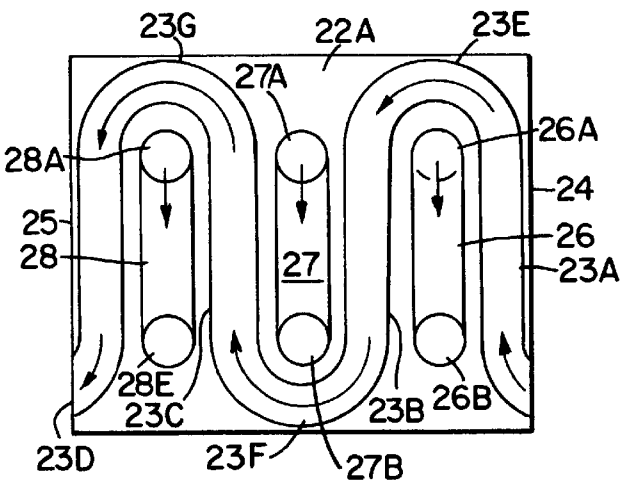
FIG. 2 is a schematic illustration of a first embodiment of a heat exchange plate useful in the heat exchanger and method of this invention.

FIG. 2 shows an embodiment of a heat exchange plate which can be used in the heat exchanger and method of this invention. In FIG. 2, plate 22 contains on a front facial surface 22A thereof a heating fluid facial subchannel 23 extending from a first transverse edge 24 to a second transverse edge 25 of surface 22A and follows a sinusoidal flow path composed of four longitudinal sides 23A–23D and three non-linear end portions 23E–23G. Surface 22A further contains three linear cooling fluid facial subchannels, 26–28, wherein subchannel 26 extends from through-hole 26A to through-hole 26B, subchannel 27 extends from through-hole 27A to through-hole 27B, and subchannel 28 extends from through-hole 28A to through-hole 28B. Subchannel 26 is positioned between longitudinal sides 23A and 23B, subchannel 27 is positioned between longitudinal sides 23B and 23C, and subchannel 28 is positioned between longitudinal sides 23C and 23D. On surface 22A, heat exchange occurs at least in the following regions:

(1) between subchannels 26 and 23A (countercurrent);

(2) between subchannels 26 and 23B (concurrent);

(3) between subchannels 26 and 23E (crosscurrent);

(4) between subchannels 27 and 23B (concurrent);

(5) between subchannels 27 and 23C (countercurrent);

(6) between subchannels 27 and 23F (crosscurrent);

(7) between subchannels 28 and 23C (countercurrent);

(8) between subchannels 28 and 23D (concurrent); and (9) between subchannels 28 and 23G (crosscurrent).

Figure 3:
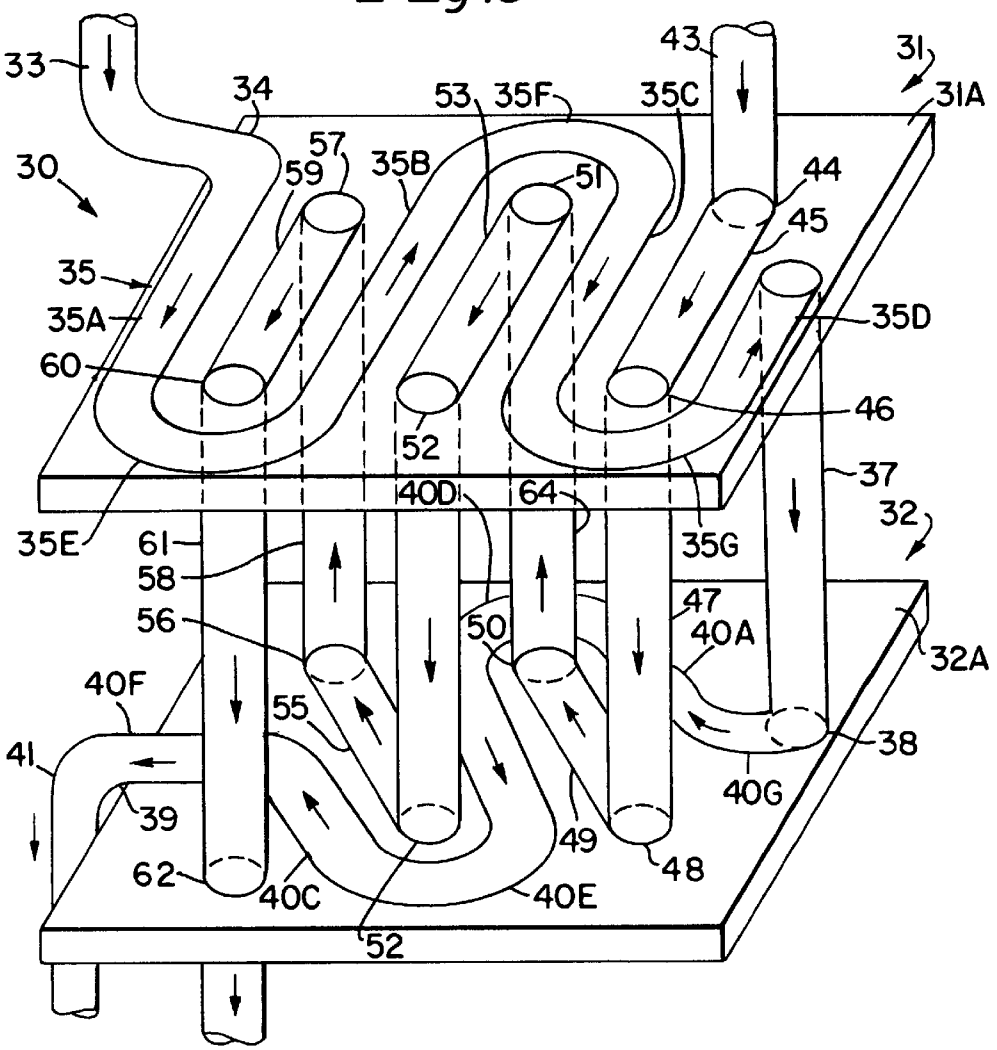
FIG. 3 is a schematic illustration of a second embodiment of a heat exchanger within the scope of this invention.

FIG. 3 illustrates a second embodiment of a heat exchanger within the scope of the present invention, wherein the heat exchanger contains two heat exchange plates having the flow patterns shown in FIG. 2. It is to be understood that the representation of the two heat exchange plates as being vertically separated from one another is for illustration purposes only. In practice, the plates are pressed together to prevent leakage therefrom and to maximize heat transfer therebetween. In FIG. 3, heat exchanger 30 is composed of two heat exchange plates, 31 and 32. From conduit 33, heating fluid H enters surface 31A of plate 31 via inlet 34 and extends over surface 31A in a sinusoidal flow channel 35 to outlet 36. Channel 35 is made up of four longitudinal portions 35A–35D and three non-linear end portions 35E–35G. From outlet 36, heating fluid H passes through channel 37 to inlet 38 on surface 32A of plate 32. From inlet 38, heating fluid H flows to outlet 39 through flow channel 40. Channel 40 is made up of three longitudinal portions 40A–40C and three non-linear end portions 40D–40F. Heating fluid H then passes through conduit 41 to exit heat exchanger 30. From conduit 43, cooling fluid C enters surface 31A of plate 31 via inlet 44. From inlet 44, cooling fluid C flows on surface 31A through flow channel 45 to outlet 46. From outlet 46, cooling fluid C flows downwardly through flow channel 47 to inlet 48 on surface 32A of plate 32. From inlet 48, cooling fluid C travels through flow channel 49 to outlet 50 and then upwardly to inlet 51 on surface 31A via subchannel 64. Cooling fluid C then flows to outlet 52 via subchannel 53, then downwardly to inlet 54 on surface 32A via subchannel 63. Cooling fluid C then travels through subchannel 55 to outlet 56, through subchannel 58 to outlet 60 and then downwardly through subchannel 61 which passes through plate 32 via through-hole 62.

In heat exchanger 30, a heat exchange relationship exists in at least the following regions but are not necessarily limited thereto:

Surface 31A (1) between subchannels 35A and 59 (concurrent);

(2) between subchannels 35E and 59 (crosscurrent);

(3) between subchannels 35B and 59 (countercurrent);

(4) between subchannels 35B and 53 (countercurrent);

(5) between subchannels 35F and 53 (crosscurrent);

(6) between subchannels 35C and 53 (concurrent);

(7) between subchannels 35C and 45 (concurrent);

(8) between subchannels 35G and 45 (crosscurrent);

(9) between subchannels 35D and 45 (countercurrent);

(10) between subchannels 43 and 35F (crosscurrent); and

(11) between subchannels 43 and 35C (crosscurrent).

Surface 32A (1) between subchannels 40A and 49 (crosscurrent);

(2) between subchannels 40D and 49 (countercurrent);

(3) between subchannels 40B and 49 (countercurrent);

(4) between subchannels 40B and 55 (countercurrent);

(5) between subchannels 40E and 55 (crosscurrent);

(6) between subchannels 40C and 55 (concurrent);

(7) between subchannels 40G and 49 (crosscurrent);

(8) between subchannels 40F and 61 (crosscurrent); and (9) between subchannels 40F and 55 (crosscurrent).

Between Surface 31A and 32A:

(1) between subchannels 35B and 55 (crosscurrent);

(2) between subchannels 35C and 49 (crosscurrent);

(3) between subchannels 59 and 40C (crosscurrent);

(4) between subchannels 53 and 40B (crosscurrent);

(5) between subchannels 45 and 40A (crosscurrent);

(6) between subchannels 37 and 47 (concurrent);

(7) between subchannels 63 and 40E (crosscurrent);

(8) between subchannels 64 and 40D (crosscurrent);

(9) between subchannels 64 and 35F (crosscurrent);

(10) between subchannels 47 and 35G (crosscurrent);

(11) between subchannels 40E and 55 (crosscurrent);

(12) between subchannels 61 and 35E (crosscurrent); and

(13) between subchannels 41 and 61 (crosscurrent).

Figure 4:
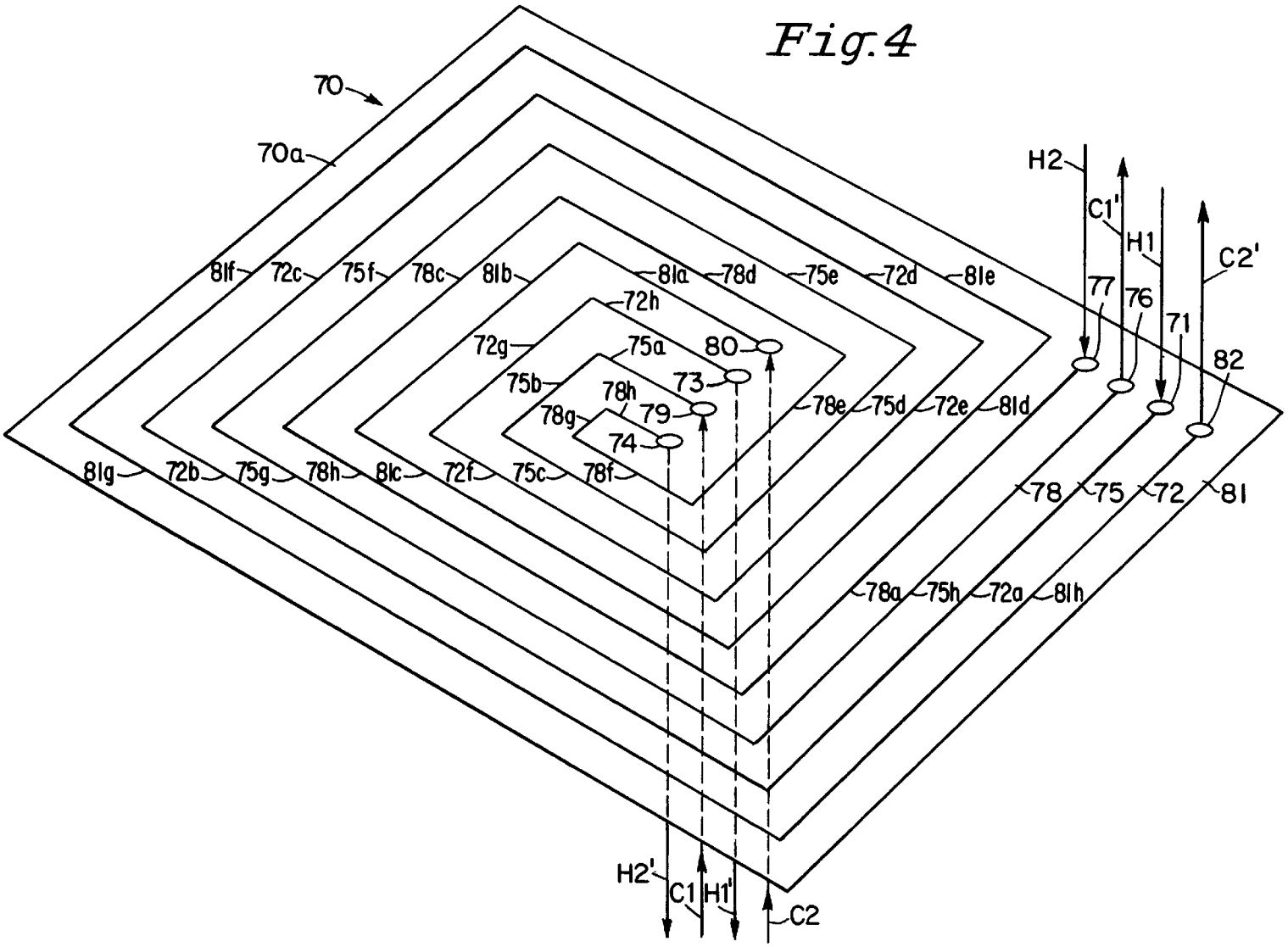
FIG. 4 is a schematic illustration of a second embodiment of a heat exchange plate useful in the heat exchanger and method of this invention.

FIG. 4 illustrates another embodiment of a heat exchange plate which can be used in the present invention in connection with two heating fluids and two cooling fluids. In FIG. 4, front facial surface 70A of plate 70 contains a plurality of alternating heating and cooling fluid facial subchannels, and a plurality of inlet and outlet ports corresponding to the heating and cooling fluid facial subchannels. A first heating fluid H1 enters heating fluid continuous facial channel 72 on surface 70*a* via inlet port 71. Channel 72 extends continuously on surface 70A to outlet 73 via facial subchannels 72*a*–72*h*. Heating fluid H1 exits outlet 73 as cooled heating fluid H1'. A first cooling fluid C1 enters cooling fluid continuous facial channel 75 via inlet port 74 on surface 70A. Channel 75 extends continuously on surface 70A to outlet 76 via facial subchannels 75*a*–75*g*. Cooling fluid C1 exits outlet 76 as cooled heating fluid C1'. A second heating fluid H2 enters heating fluid continuous facial channel 78 via inlet port 77 on surface 70A. Channel 78 extends continuously on surface 70A to outlet 79 via facial subchannels 78*a*–78*h*. Heating fluid H2 exits outlet 79 as cooled heating fluid H2'. A second cooling fluid C2 enters cooling fluid continuous facial channel 81 via inlet port 80 on surface

70A. Channel 81 extends continuously on surface 70A to outlet 82 via facial subchannels 81*a*–81*h*. Cooling fluid C1 exits outlet 82 as cooled heating fluid C2'.

On surface 70A of plate 70, at least the following facial subchannels are mutually aligned in a heat exchange relationship, each of which being a countercurrent heat exchange relationship:

(1) heating fluid facial subchannel 72*a* and cooling fluid facial subchannels 75*h* and 81*h;*

(2) heating fluid facial subchannel 72*b* and cooling fluid facial subchannels 75*g* and 81*g;*

(3) heating fluid facial subchannel 72*c* and cooling fluid facial subchannels 75*f* and 81*f;*

(4) heating fluid facial subchannel 72*d* and cooling fluid facial subchannels 75*e* and 81*e;*

(5) heating fluid facial subchannel 72*e* and cooling fluid facial subchannels 75*d* and 81*d;*

(6) heating fluid facial subchannel 72*f* and cooling fluid facial subchannels 75*c* and 81*c;*

(7) heating fluid facial subchannel 72*g* and cooling fluid facial subchannels 75*b* and 81*b;*

(8) heating fluid facial subchannel 72*h* and cooling fluid facial subchannels 75*a* and 81*a;*

(9) heating fluid facial subchannel 78*a* and cooling fluid facial subchannels 75*h* and 81*d;*

(10) heating fluid facial subchannel 78*b* and cooling fluid facial subchannels 75*g* and 81*c;*

(11) heating fluid facial subchannel 78*c* and cooling fluid facial subchannels 75*f* and Bib;

(12) heating fluid facial subchannel 78*d* and cooling fluid facial subchannels 75*e* and 81*a;*

(13) heating fluid facial subchannel 78*e* and cooling fluid facial subchannel 75*d;*

(14) heating fluid facial subchannel 78*f* and cooling fluid facial subchannel 75*c;*

(15) heating fluid facial subchannel 78*g* and cooling fluid facial subchannel 75*b;*

(16) heating fluid facial subchannel 78*h* and cooling fluid facial subchannel 75*a.*

Thus, as can be seen in FIGS. 1–4 hereinabove, the heat exchanger and method of this invention provides heat exchange between heating and cooling fluids on a common surface of a heat exchange plate, and can further provide heat exchange in three dimensions with the use of two or more heat exchange plates.

What is claimed is:

1. A heat exchanger, comprising a plurality of heat exchange plates stacked in a parallel, adjacent, front-to-back facial configuration, each of said heat exchange plates having on a front facial surface thereof:

(A) a first heating fluid facial subchannel set comprising at least one heating fluid facial subchannel; and (B) a first cooling fluid facial subchannel set comprising at least one cooling fluid facial subchannel;

wherein the first heating fluid facial subchannel set and the first cooling fluid facial subchannel set are mutually aligned in a first heat exchange relationship on the common facial surface, further wherein:

(i) said first heating fluid facial subchannel set and said first cooling fluid facial subchannel set each have a linear flow path and said first heat exchange relationship comprises a countercurrent, concurrent or cross-current heat exchange relationship;

(ii) said first heating fluid facial subchannel set has a linear flow path and said first cooling fluid facial subchannel set has a non-linear flow path or said first heating fluid facial subchannel set has a non-linear flow path and said first cooling fluid facial subchannel set has a linear flow path, and said first heat exchange relationship consists of a concurrent heat exchange relationship; or (iii) one of said first heating fluid facial subchannel set and said first cooling fluid facial subchannel set has a linear flow path and the other of said first heating fluid facial subchannel set and said first cooling fluid facial subchannel set has a non-linear flow path, wherein said non-linear flow path comprises a first longitudinal portion, a second longitudinal portion and a third non-linear end portion contiguous with said first longitudinal portion and said second longitudinal portion, wherein said linear flow path and said first longitudinal portion are mutually aligned in a concurrent or countercurrent heat exchange relationship; said linear flow path and said second longitudinal portion are mutually aligned in a concurrent or countercurrent heat exchange relationship; and said linear flow path and said third non-linear end portion are mutually aligned in a cross-current heat exchange relationship.

2. A heat exchanger according to claim 1, wherein the first heating fluid facial subchannel set contains a plurality of first heating fluid facial subchannels and the first cooling fluid facial subchannel set contains a plurality of first cooling fluid facial subchannels.

3. A heat exchanger according to claim 2, wherein the plurality of first heating fluid facial subchannels and the plurality of first cooling fluid facial subchannels are mutually aligned such that the plurality of first heating fluid facial subchannels and the plurality of first cooling fluid facial subchannels alternate with one another on the common facial surface.

4. A heat exchanger according to claim 1, wherein said plurality of heat exchange plates contains at least one pair of heat exchange plates, said at least one pair comprising a first heat exchange plate and a second heat exchange plate, wherein the first heat exchange plate has on a front facial surface thereof a first first-plate heating fluid facial subchannel set comprising one or more first-plate heating fluid facial subchannels and a first first-plate cooling fluid facial subchannel set comprising one or more first-plate cooling fluid facial subchannels, wherein the second heat exchange plate comprises on a front facial surface thereof a first second-plate heating fluid facial subchannel set comprising one or more second-plate heating fluid facial subchannels and a first second-plate cooling fluid facial subchannel set comprising one or more second-plate cooling fluid facial subchannels, wherein:

(a) the first first-plate heating fluid facial subchannel set and the first first-plate cooling fluid facial subchannel set are mutually aligned in a fifth heat exchange relationship;

(b) the first second-plate heating fluid facial subchannel set and the first second-plate cooling fluid facial subchannel set are mutually aligned in a sixth heat exchange relationship;

(c) the first first-plate heating fluid facial subchannel set and the first second-plate cooling fluid facial subchannel set are mutually aligned in a seventh heat exchange relationship; and (d) the first first-plate cooling fluid facial subchannel set and the first second-plate heating fluid facial subchannel set are mutually aligned in an eighth heat exchange relationship.

5. A heat exchanger according to claim 4, wherein the fifth heat exchange relationship comprises a concurrent or countercurrent heat exchange relationship; the sixth heat exchange relationship comprises a concurrent or countercurrent heat exchange relationship; the seventh heat exchange relationship comprises a concurrent, countercurrent or crosscurrent heat exchange relationship; and the eighth heat exchange relationship comprises a concurrent, countercurrent or crosscurrent heat exchange relationship.

6. A heat exchanger according to claim 4, wherein said first first-plate heating fluid facial subchannel set, said first first-plate cooling fluid facial subchannel set, said first second-plate heating fluid facial subchannel set, and said first second-plate cooling fluid facial subchannel set have been formed by an etching process.

7. A heat exchanger according to claim 1, wherein said heat exchange plates each has a thickness of greater than about 0.001 inch to about 1.0 inch.

8. A heat exchanger according to claim 7, wherein said heat exchange plates each has a thickness of from about 0.001 to about 0.25 inch.

9. A heat exchanger according to claim 8, wherein said heat exchange plates each has a thickness of about 0.010 inch.

10. A heat exchanger according to claim 1, wherein the at least one heating fluid facial subchannel and the at least one cooling fluid facial subchannel are situated on a common facial surface of a heat exchange plate having a thickness of a given value, and the at least one heating fluid facial subchannel and the at least one cooling fluid facial subchannel each have a depth of at least about 70% of said given value.

11. A heat exchanger according to claim 1, wherein the at least one heating fluid facial subchannel and the at least one cooling fluid facial subchannel each have a depth of less than or equal to about 0.25 inch.

12. A heat exchanger according to claim 11, wherein the at least one heating fluid facial subchannel and the at least one cooling fluid facial subchannel each have a depth of less than or equal to about 0.10 inch.

13. A heat exchanger according to claim 11, wherein said thermally conductive material comprises a metal.

14. A heat exchanger according to claim 13, wherein said metal is selected from the group consisting of stainless steel, aluminum, aluminum-based alloys, nickel, iron, copper, copper-based alloys, mild steel, brass, and titanium.

15. A heat exchanger according to claim 1, wherein the at least one heating fluid facial subchannel and the at least one cooling fluid facial subchannel are mutually separated by a distance of no greater than about 0.25 inch.

16. A heat exchanger according to claim 1, wherein said heat exchange plates each comprises a thermally conductive material.

17. A heat exchanger according to claim 1, wherein said first heating fluid facial subchannel set and said first cooling fluid facial subchannel set are each micromachined structures.

18. A heat exchanger according to claim 17, wherein said micromachined structures are selected from the group consisting of etched structures, stamped structures, punched structures, pressed structures, cut structures, molded structures, milled structures, lithographed structures, and particle blasted structures.

19. A heat exchanger according to claim 18, wherein said micromachined structures are etched structures.

20. A method of exchanging heat between one or more heating fluids and one or more cooling fluids, comprising the steps of:

(1) providing a heat exchanger comprising a plurality of heat exchange plates stacked in a parallel, adjacent, front-to-back facial configuration, each of said heat exchange plates having on a front facial surface thereof:

(A) a first heating fluid facial subchannel set comprising at least one heating fluid facial subchannel; and (B) a first cooling fluid facial subchannel set comprising at least one cooling fluid facial subchannel;

wherein the first heating fluid facial subchannel set and the first cooling fluid facial subchannel set are mutually aligned in a first heat exchange relationship on the common facial surface;

further wherein:

(i) said first heating fluid facial subchannel set and said first cooling fluid facial subchannel set each have a linear flow path and said first heat exchange relationship comprises a countercurrent, concurrent or crosscurrent heat exchange relationship;

(ii) said first heating fluid facial subchannel set has a linear flow path and said first cooling fluid facial subchannel set has a non-linear flow path or said first heating fluid facial subchannel set has a non-linear flow path and said first cooling fluid facial subchannel set has a linear flow path, and said first heat exchange relationship consists of a concurrent heat exchange relationship; or (iii) one of said first heating fluid facial subchannel set and said first cooling fluid facial subchannel set has a linear flow path and the other of said first heating fluid facial subchannel set and said first cooling fluid facial subchannel set has a non-linear flow path, wherein said non-linear flow path comprises a first longitudinal portion, a second longitudinal portion and a third non-linear end portion contiguous with said first longitudinal portion and said second longitudinal portion, wherein said linear flow path and said first longitudinal portion are mutually aligned in a concurrent or countercurrent heat exchange relationship; said linear flow path and said second longitudinal portion are mutually aligned in a concurrent or countercurrent heat exchange relationship: and said linear flow path and said third non-linear end portion are mutually aligned in a crosscurrent heat exchange relationship; and (2) passing the one or more heating fluids through the first heating fluid facial subchannel set, while passing the one or more cooling fluids through the first cooling fluid facial subchannel set.

21. A method according to claim 20, wherein:

(i) said said plurality of heat exchange plates comprises at least one pair of heat exchange plates, wherein said at least one pair comprises a first heat exchange plate and a second heat exchange plate, said first heat exchange plate having on a front facial surface thereof a first first-plate heating fluid facial subchannel set comprising one or more first-plate heating fluid facial subchannels and a first first-plate cooling fluid facial subchannel set comprising one or more first-plate cooling fluid facial subchannels; and said second heat exchange plate comprises on a front facial surface thereof a first second-plate heating fluid facial subchannel set comprising one or more second-plate heating fluid facial subchannels and a first second-plate cooling fluid facial subchannel set comprising one or more second-plate cooling fluid facial subchannels; wherein:

(a) said first first-plate heating fluid facial subchannel set and said first first-plate cooling fluid facial subchannel set are mutually aligned in a fifth heat exchange relationship;

(b) said first second-plate heating fluid facial subchannel set and said first second-plate cooling fluid facial subchannel set are mutually aligned in a sixth heat exchange relationship;

(c) said first first-plate heating fluid facial subchannel set and said first second-plate cooling fluid facial subchannel set are mutually aligned in a seventh heat exchange relationship; and (d) said first first-plate cooling fluid facial subchannel set and said first second-plate heating fluid facial subchannel set are mutually aligned in an eighth heat exchange relationship; and (ii) said method comprises passing said one or more heating fluids through said first first-plate heating fluid facial subchannel set and through said first second-plate heating fluid facial subchannel set while passing said one or more cooling fluids through said first first-plate cooling fluid facial subchannel set and through said first second-plate cooling fluid facial subchannel set.

22. A heat exchanger, comprising a single heat exchange plate, said heat exchange plate having on a common facial surface thereof:

(A) a first heating fluid facial subchannel set comprising at least one heating fluid facial subchannel; and (B) a first cooling fluid facial subchannel set comprising at least one cooling fluid facial subchannel;

wherein the first heating fluid facial subchannel set and the first cooling fluid facial subchannel set are mutually aligned in a first heat exchange relationship on the common facial surface;

further wherein (i) said first heating fluid facial subchannel set and said first cooling fluid facial subchannel set each have a linear flow path, (ii) said first heating fluid facial subchannel set has a non-linear flow path and said first cooling fluid facial subchannel set has a linear flow path and said first heat exchange relationship consists of a concurrent heat exchange relationship;, (iii) said first cooling fluid facial subchannel set has a non-linear flow path and said first heating fluid facial subchannel set has a linear flow path and said first heat exchange relationship consists of a concurrent heat exchange relationship; or (iv) one of said first heating fluid facial subchannel set and said first cooling fluid facial subchannel set has a linear flow path and the other of said first heating fluid facial subchannel set and said first cooling fluid facial subchannel set has a non-linear flow path, wherein said non-linear flow path comprises a first longitudinal portion, a second longitudinal portion and a third non-linear end portion contiguous with said first longitudinal portion and said second longitudinal portion, wherein said linear flow path and said first longitudinal portion are mutually aligned in a concurrent or countercurrent heat exchange relationship; said linear flow path and said second longitudinal portion are mutually aligned in a concurrent or countercurrent heat exchange relationship; and said linear flow path and said third non-linear end portion are mutually aligned in a crosscurrent heat exchange relationship.

23. A heat exchanger according to claim 22, wherein said heat exchange plate has a thickness of greater than about 0.001 inch to about 1.0 inch.

24. A heat exchanger according to claim 22, wherein said heat exchange plate comprises a thermally conductive material.

25. A heat exchanger according to claim 22, wherein said first heating fluid facial subchannel set and said first cooling fluid facial subchannel set are each micromachined structures.

26. A method of exchanging heat between one or more heating fluids and one or more cooling fluids, comprising the steps of:

(1) providing a heat exchanger comprising a single heat exchange plate, said heat exchange plate having on a common facial surface thereof:

(A) a first heating fluid facial subchannel set comprising at least one heating fluid facial subchannel; and (B) a first cooling fluid facial subchannel set comprising at least one cooling fluid facial subchannel;

wherein the first heating fluid facial subchannel set and the first cooling fluid facial subchannel set are mutually aligned in a first heat exchange relationship on the common facial surface;

further wherein (i) said first heating fluid facial subchannel set and said first cooling fluid facial subchannel set each have a linear flow path, (ii) said first heating fluid facial subchannel set has a non-linear flow path and said first cooling fluid facial subchannel set has a linear flow path and said first heat exchange relationship consists of a concurrent heat exchange relationship; (iii) said first cooling fluid facial subchannel set has a non-linear flow path and said first heating fluid facial subchannel set has a linear flow path and said first heat exchange relationship consists of a concurrent heat exchange relationship; or (iv) one of said first heating fluid facial subchannel set and said first cooling fluid facial subchannel set has a linear flow path and the other of said first heating fluid facial subchannel set and said first cooling fluid facial subchannel set has a non-linear flow path, wherein said non-linear flow path comprises a first longitudinal portion. a second longitudinal portion and a third non-linear end portion contiguous with said first longitudinal portion and said second longitudinal portion, wherein said linear flow path and said first longitudinal portion are mutually aligned in a concurrent or countercurrent heat exchange relationship; said linear flow path and said second longitudinal portion are mutually aligned in a concurrent or countercurrent heat exchange relationship; and said linear flow path and said third non-linear end portion are mutually aligned in a crosscurrent heat exchange relationship; and (2) passing the one or more heating fluids through the first heating fluid facial subchannel set in a first flow direction, while passing the one or more cooling fluids through the first cooling fluid facial subchannel set in a second flow direction.

27. A method of exchanging heat between one or more heating fluids and one or more cooling fluids, comprising the steps of:

(1) providing a heat exchanger comprising a single heat exchange plate, said heat exchange plate having on a common facial surface thereof:

(A) a first heating fluid facial subchannel set comprising at least one heating fluid facial subchannel; and (B) a first cooling fluid facial subchannel set comprising at least one cooling fluid facial subchannel;

wherein the first heating fluid facial subchannel set and the first cooling fluid facial subchannel set are mutually aligned in a first heat exchange relationship on the common facial surface, further wherein the first heating fluid facial subchannel set and the first cooling fluid facial subchannel set each have a linear flow path; and (2) passing the one or more heating fluids through the first heating fluid facial subchannel set in a first flow direction, while passing the one or more cooling fluids through the first cooling fluid facial subchannel set in a second flow direction, wherein said first flow direction is countercurrent with respect to said second flow direction.

* * * * *